US008376160B2

(12) United States Patent
Bomgardner et al.

(10) Patent No.: US 8,376,160 B2
(45) Date of Patent: Feb. 19, 2013

(54) KEY RETAINER FOR RAILWAY CAR COUPLER

(76) Inventors: Charles T. Bomgardner, Burleson, TX (US); Ike S. Sowden, Columbus, NJ (US); Andrès Paul Montoya Moncayo, North Plainfield, NJ (US)

( * ) Notice: Subject to any disclaimer, the term of this patent is extended or adjusted under 35 U.S.C. 154(b) by 163 days.

(21) Appl. No.: 13/093,464

(22) Filed: Apr. 25, 2011

(65) Prior Publication Data

US 2012/0267333 A1 Oct. 25, 2012

(51) Int. Cl.
*B61G 9/20* (2006.01)

(52) U.S. Cl. ..... 213/50.5; 213/61

(58) Field of Classification Search ..... 213/50.5, 213/61, 69, 75 R; 105/200
See application file for complete search history.

(56) References Cited

U.S. PATENT DOCUMENTS 1,657,864 A * 1/1928 McMullen ..... 213/50.5
1,761,266 A * 6/1930 Johnston et al. ..... 213/50.5
1,763,975 A * 6/1930 Lewis ..... 213/69
1,816,356 A * 7/1931 Barrows ..... 213/50.5
1,925,923 A * 9/1933 Hicks ..... 213/50.5
3,589,527 A 6/1971 Seay et al. ..... 213/8
3,802,577 A * 4/1974 Niggemeier et al. ..... 213/50.5
3,994,402 A 11/1976 Young ..... 213/50
5,096,076 A * 3/1992 Elliott et al. ..... 213/67 A
2012/0267333 A1* 10/2012 Bomgardner et al. ..... 213/50.5

OTHER PUBLICATIONS

International Search Report and Written Opinion From Corresponding International Application No. PCT/US12/30688, Mailed Jun. 12, 2012—13 pages.

* cited by examiner

*Primary Examiner* — Jason C Smith
(74) *Attorney, Agent, or Firm* — Brendan Mee Law, P.C.

(57) ABSTRACT

A key retainer for retaining a draft key in the key slot of a railway car yoke is mounted on the outside of the sill of a railway car. Mounting the key retainer with a retainer key system on the outside of the sill, and aligned with the sill cutout, permits ease of visual inspection of the retainer from outside the railway car, and allows for repair of the key retainer without disassembling the coupler from the yoke, or the yoke from the railway car.

18 Claims, 5 Drawing Sheets

KEY RETAINER FOR RAILWAY CAR COUPLER

BACKGROUND OF THE INVENTION

1. Field of the Invention

The invention is directed to a key retainer system for a railway cushion car which prevents a coupler key from sliding out of a key slot in a yoke and which keeps the coupler key inside the sill. The key retainer system according to the invention comprises a key retainer mounted on a cutout on the outside of a railway car sill. The key retainer system further comprises improvements to a standard E-type cushioned yoke which permit the coupler key to extend completely through the key slots in the yoke. Mounting the key retainer on the exterior of the sill ensures improved visibility of the key retainer from outside the railway car, and allows the key retainer to be repaired and/or inspected without disassembling the coupler from the yoke or the yoke from the railway car. The exterior mounting also permits the coupler key to be inserted completely through an E-type yoke, ensuring that the key cannot be rotated out of position.

2. Description of the Prior Art

Two adjacent railway cars are joined by a coupler, which extends into a yoke mounted in a generally rectangular housing on a lower portion of the railway car known as the "sill." The coupler is secured to the yoke by a coupler key (also called a "draft key") which extends through aligned key slots in the coupler and the yoke.

The key is prevented from shifting or falling out of the yoke with a key retainer. The prior art systems are characterized by a stop member mounted on the inside of the yoke. In a typical prior art arrangement, the yoke is retained in the key slots with the aid of corresponding notches formed in the yoke and in the coupler key. The coupler key is inserted in a first key slot in the yoke until a notch in the key abuts a mating notch in the opposite wall of the yoke. A stop member located on the inside of the yoke swivels into position against a similar notch on a side of the coupler key opposite the first side. This is sometimes called a "blind key retainer," because the stop member is mounted inside the yoke and is not visible, or at least not readily visible, from outside the railway car. An example of this arrangement is seen in U.S. Pat. No. 3,589,527.

The prior art arrangement has several drawbacks. From a safety standpoint, the state of the key retainer cannot be easily inspected. Even as digital vision inspection technology improves, the blind key retainer system does not lend itself to robotic digital vision comparisons. Further, because the stop member is mounted on the inside of the yoke, it cannot be easily accessed for repair, requiring removal of at least the coupler to repair the retainer system.

SUMMARY OF THE INVENTION

These and other objects of the invention are realized with a key retainer and key retainer system according to the invention. The key retainer comprises: a retainer guide having an open end, a closed end, and two opposed sides extending from the closed end defining a slot. Two opposed flanges extend from either side of the slot, and each flange has a through hole, positioned so that the through holes can be vertically aligned. A key stop is inserted in the open end of the retainer guide and is slidable within the retainer guide to a position abutting the closed end of the retainer guide. The key stop also has a flange with a through hole, which is vertically aligned with the through holes on the flanges on the retainer guide when the key stop is abutting the closed end of the retainer guide. A locking member, such as a pin or bolt, is received in the aligned through holes to secure the key stop in the retainer guide. With this configuration, the retainer guide is adapted to be mounted on the outside of a railway car sill having a cutout at one end exposing at least a portion of a key slot on a yoke, so that at least a portion of the retainer guide is aligned with at least a portion of the cutout on the sill.

Mounting a key retainer system on the outside of the sill, as described above, provides for the status and integrity of the key retainer to be verified by visual inspection. An automated vision system that performs inspection while a train is in service or moving may readily be adapted to include a check of the integrity of the key retainer. Also, all maintenance, inspection, and repair can be performed while the yoke, cushion unit and coupler are installed.

A key retainer system according to the invention includes the above-described key retainer, a sill attached to the lower portion of the railway car (which may be identical to a sill found in the prior art) provided with a cutout in one of the lateral sides permitting access to a coupler key, and a yoke having uniform key slots sized to allow a draft key to be inserted all the way through the yoke, so that the draft key extends from one inner wall of the sill to the other inner wall. The system is especially adapted for a yoke which is mounted in the sill with sliding clearance and which has a recess to receive a cushion unit, including a surface for the cushion unit to bear on. This arrangement is called a "floating E-type" yoke to distinguish certain earlier yoke configurations in which the yoke and the cushion unit were integrated as a single unit. Because the coupler key does not abut the sides of the key slots on the yoke, as in the prior art, the coupler key may extend completely through the two opposed key slots in the yoke, which makes it impossible for the key to rotate out of position and cause the yoke to detach from the coupler, even while in the 'buff' position, a rare but catastrophic event known to occur in the prior art. Further, the member which holds the key retainer in place according to the invention is not subject to load when lateral loads are applied to the yoke, which may happen in normal operation. These and other advantages of the invention will be described in the detailed description which follows.

DETAILED DESCRIPTION OF THE PREFERRED EMBODIMENTS

Figure 1:
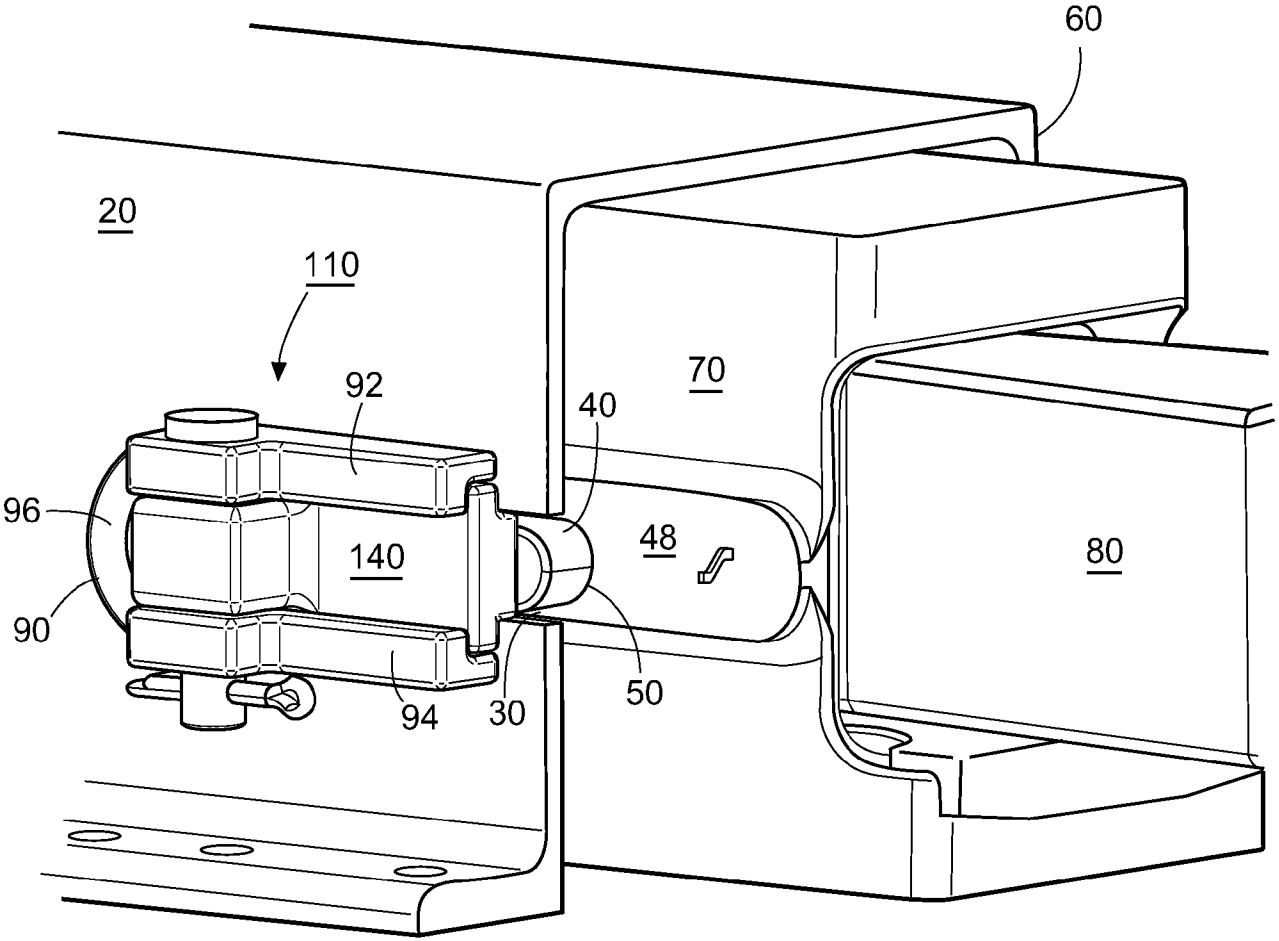
FIG. 1 is a perspective view of the key retainer system according to the invention.

Referring to FIG. 1, a standard sill 20 is shown with a sill cutout 30 which permits access to a draft key 40 in a yoke key slot 50. The side of the sill opposite the sill cutout (not shown) does not have a cutout and has an unbroken surface. That is, edge 60 is an uninterrupted straight line. Coupler shank 80 is received in yoke 70 and is attached to the yoke by the draft key 40. Yoke 70 is mounted within the sill and is preferably a floating E-type yoke. By "floating" is meant that a recess 82 (see FIG. 3) is provided in the yoke so that a cushion unit can be mounted as a separate element, and the yoke is provided with a surface for the cushion unit to bear on, in a shock absorbing manner when a force is applied to the coupler in a direction toward the body of the railway car (i.e., a "buff condition").

The key retainer 110 is mounted in alignment with the cutout 30 in the sill 20. Key retainer 110 comprises retainer guide 90 having an open end corresponding to the open end of sill cutout 30. Two opposed sides 92, 94 extend from closed end 96 of the retainer guide, forming a slot in which key stop 140 is slidable. At least a portion of the retainer guide 90 is aligned with the cutout in the sill such that a side of the retainer guide 90 is close to the edge of the sill cutout, but preferably does not narrow the opening of the sill cutout. Most preferably, the opposed sides 92, 94 and the closed end 96 of the retainer guide line up with corresponding edges of the sill cutout. Mounting of the key retainer system may be done by welding the key retainer directly to the sill, or by mechanical means, such as by bolting. In addition to making the key retainer more visible, the sill is more adaptable to different means of attachment than the yoke itself, which is conventionally where a key retainer system is mounted. In the most preferred embodiments, the key retainer is mounted on the flat wall of the sill, and is not mounted on a flange. In FIG. 1, the yoke is shown extending partially from the sill. In a buff condition, the yoke may be inserted entirely inside the sill, inward of the point where the key aligns with the key retainer. Reinforcing boss 48 provides reinforcement on the yoke around the area of key slot 50.

Figure 2:
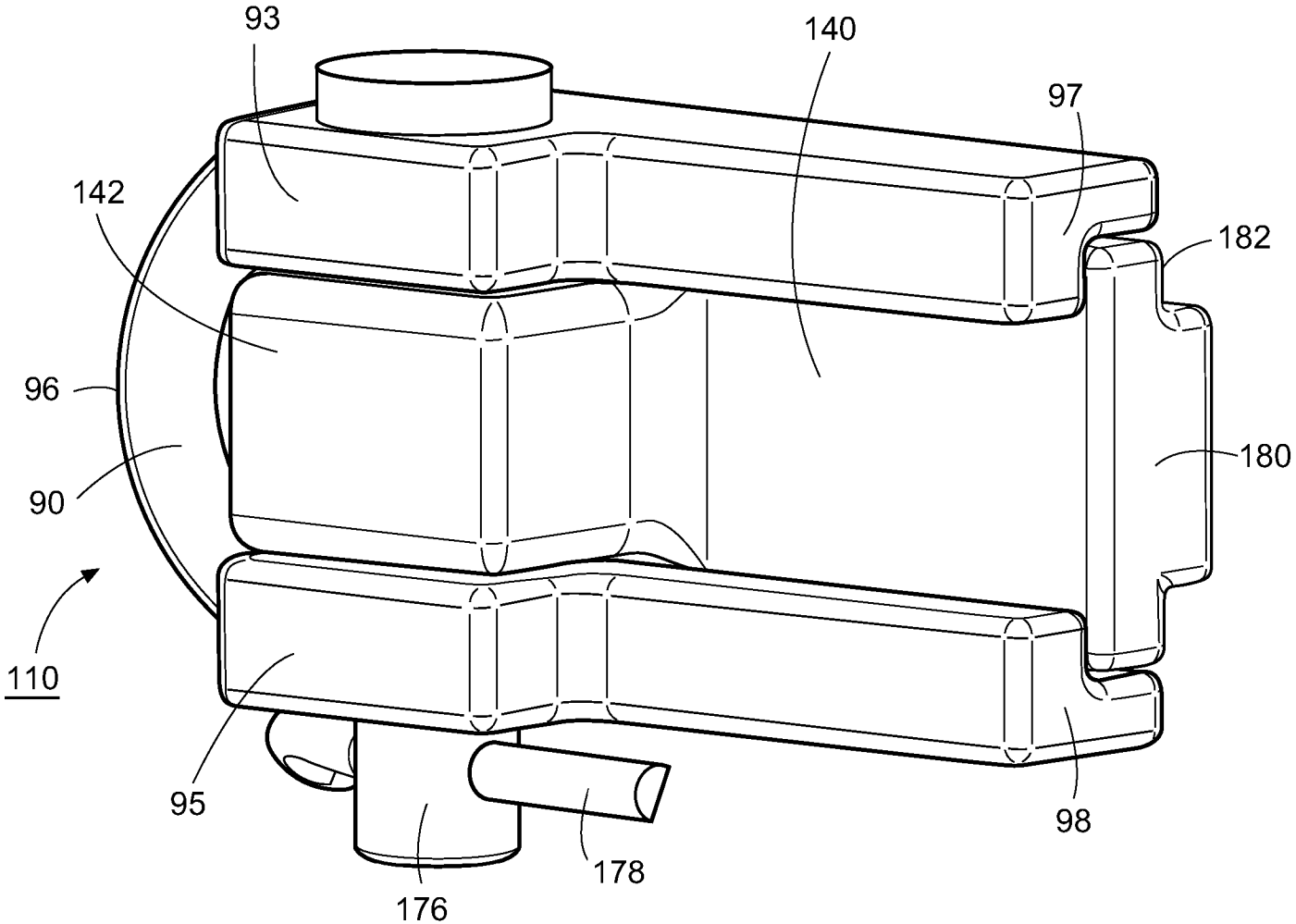
FIG. 2 is a perspective detail view of the key retainer.

Key stop 140 physically retains the draft key and is preferably mounted so that an interior surface is about flush with an interior surface of the sill wall. Although the key retainer may protrude an insignificant amount into the interior of the sill (no more than a few millimeters), it is preferably flush. As seen in the detail of FIG. 2, this can be achieved by providing the key stop 140 with a protuberance 180 which fits in the sill cutout. Another surface 182 of the key stop slides along the edge of the sill cutout 30. Preferably, the key stop slides into position abutting the closed end of the retainer guide and the corresponding closed end of the sill cutout. In the most preferred embodiments, the key stop 140 is about co-extensive with an end side of the draft key 40, so that substantially an entire facing surface of the key stop abuts the end surface of a draft key 40 inserted through the key slots on the yoke. This tends to maximize the ability of the key stop to retain the key in position. The key stop 140 is preferably retained in the retainer guide 90 by flanges 97, 98.

To retain the key stop 140 in the retainer guide 90, two flanges 93, 95 extend from the sides of the retainer guide and are provided with aligned through holes. A further flange 142 on the key stop is provided with a through hole aligned with the through holes on the retainer guide flanges 93, 95. A locking member 176 is received in the aligned through holes and may be secured in any fashion known in the art. For example, the locking member may be tack welded, or it may be a threaded bolt provided with a nut. Alternatively the locking member may be provided with threads which mate with threads provided in the retainer guide. In the embodiment shown, locking member 176 is provided with a hole for receiving cotter pin 178 to secure the pin and keep the key stop in place. It is preferred, but not critical, that flanges 93, 95 extend from opposed sides of the retainer guide adjacent to closed end of the retainer guide. An advantage of the described arrangement, is that even in the case where the draft key is subjected to a lateral load, as may sometimes happen in operation, the locking member 176 is not subjected to load.

As can be seen from FIG. 1, draft key 40 is arranged horizontally, typical of an E-type yoke. The coupler key for an E-type yoke is a generally flat horizontally arranged element, longer than it is wide and wider than it is thick. As used herein to describe an E-type coupler key, the "length" is the longest dimension, in a direction through the key slot in the coupler. The "width" is a dimension in a direction parallel to the direction of motion of the train. The "thickness" dimension is orthogonal to the length and width dimensions, in the up-and-down direction.

Figure 3:
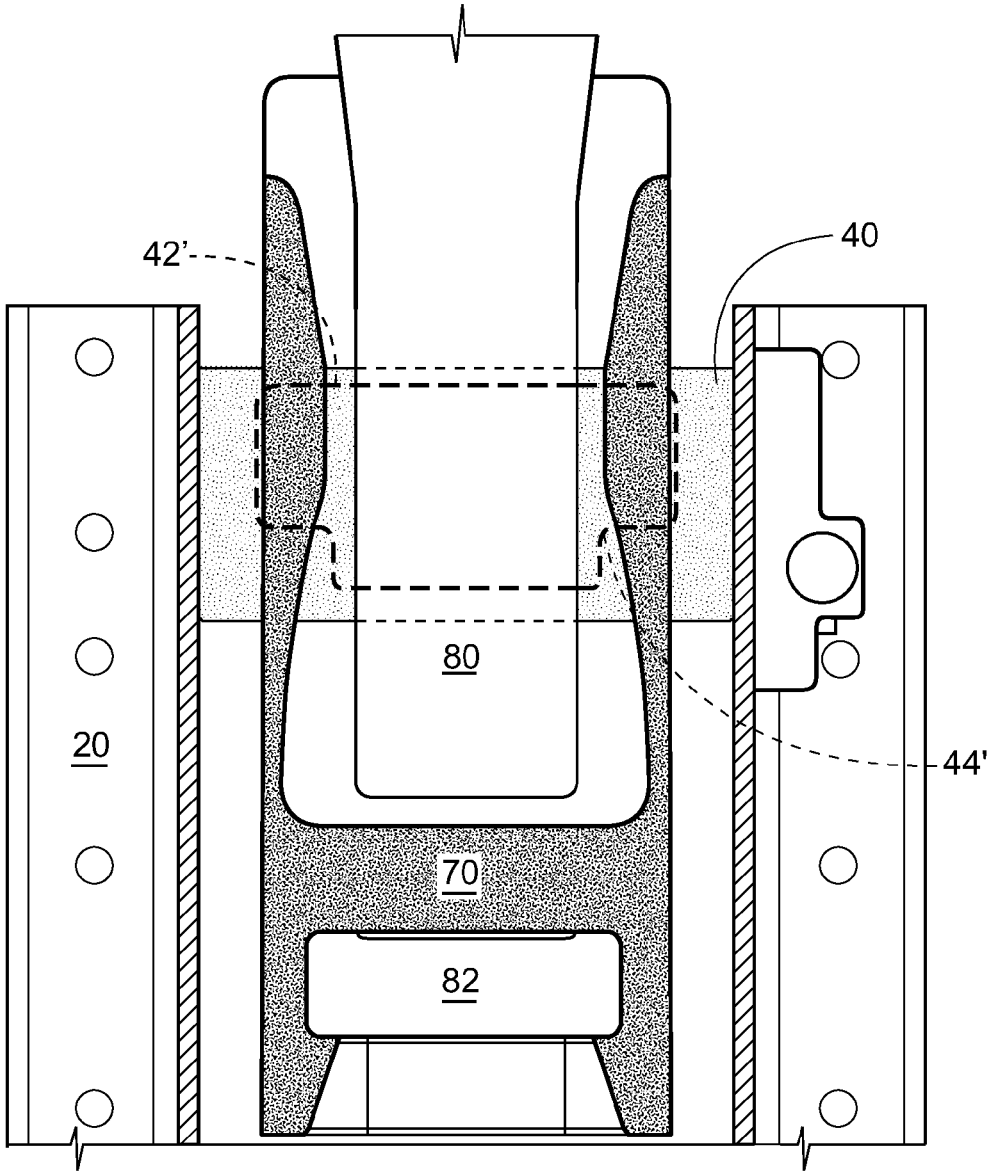
FIG. 3 is plan cutaway view of the key retainer system, including the sill, yoke, coupler, coupler key, and key retainer; the dotted lines depict the top profile of a key according to the prior art.
Figure 4A:
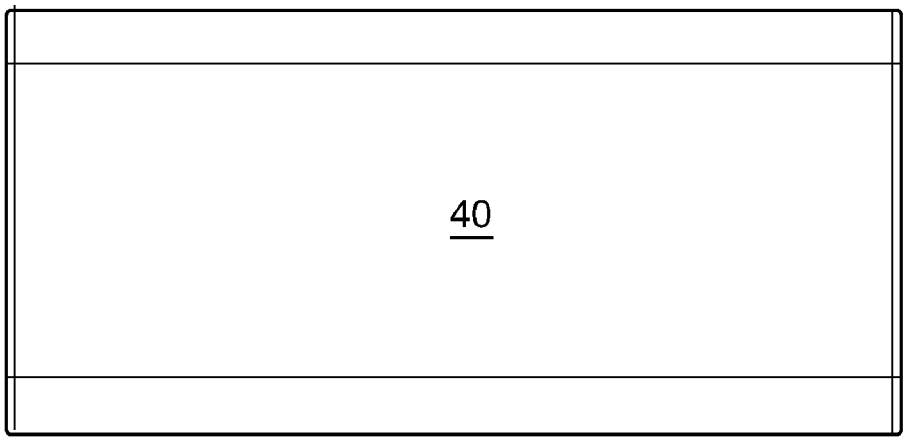
FIG. 4A is a plan view of a draft key that can be used in a key retainer system according to the invention.

FIG. 4A depicts a coupler key 40 that may be used in a key retainer system according to the invention. As seen in the view of FIG. 3, the key 40 has a rectangular profile when viewed from above, without notches designed for engagement with a key slot of the yoke. This is contrasted with the profile of a prior art key, yoke and coupler combination shown in dotted lines in FIG. 3. While the top profile of key 40 itself may be known in the prior art, its use with a system according to the invention in a floating E-type yoke is not previously disclosed. That is, the coupler key 40 is preferably provided with a width of preferably about 6 inches, sufficient to be received in the key slots of the coupler and yoke with just enough clearance to slide in. The length is preferably about 12¾ inches, allowing the key to extend from one inner sill wall to the other inner sill wall. Thus, according to the invention, the yoke key slot is preferably unobstructed so that it can accommodate the width of the coupler key and allow the coupler key 40 to pass all the way through.

Figure 4B:
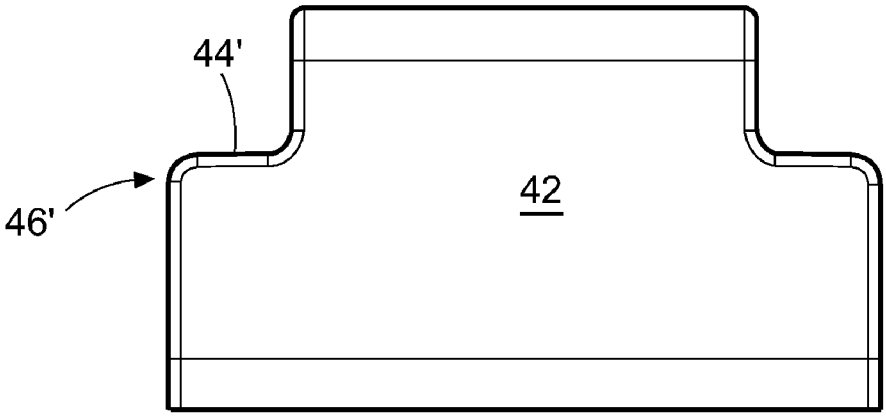
FIG. 4B Prior Art
FIG. 4B is a plan view of a draft key according to the prior art.

FIG. 4B depicts just one of many commercial key designs in the prior art where the sides of the key are modified to engage with the key slot of the yoke or with an interior-mounted key retainer element. The notches may be placed differently, but the end result is generally a non-rectangular profile when viewed from above, as in FIG. 4B. A key according to the prior art may become worn on the corners 46 when the yoke is subjected to lateral loads. A yoke according to the invention is free of interior moving parts which engage the coupler key, and the key is preferably free of corners engaging the key slot of the yoke.

The plan cutaway view of FIG. 3 shows an E-type yoke with the draft key 40 extending completely through the yoke from one inner wall of the sill to the other inner wall (one wall having a cutout). An advantage of this arrangement is that the draft key is prevented from rotating out of position, even when force is applied to the coupler over an extended period of time. Dotted lines depict, in plan view, a draft key 42' that would be used with a prior art key retainer system. With a key engaging the key slot, as in the prior art, the likelihood is greater that the key will rotate out of position de-coupling the yoke from the coupler (a rare but not unknown occurrence). Further, surface 44', formed by a notch in the draft key, engages a pivoting key retainer (such as 48' shown in FIG. 5), which may be subjected to lateral forces when typical operational forces are applied to the coupler and yoke.

Recess 82 is provided in the yoke 70 to receive a cushion unit (not shown) so that the cushion unit and yoke are separable, which also provides for easier construction and repair of the coupler, yoke and cushion unit assembly.

Figure 5:
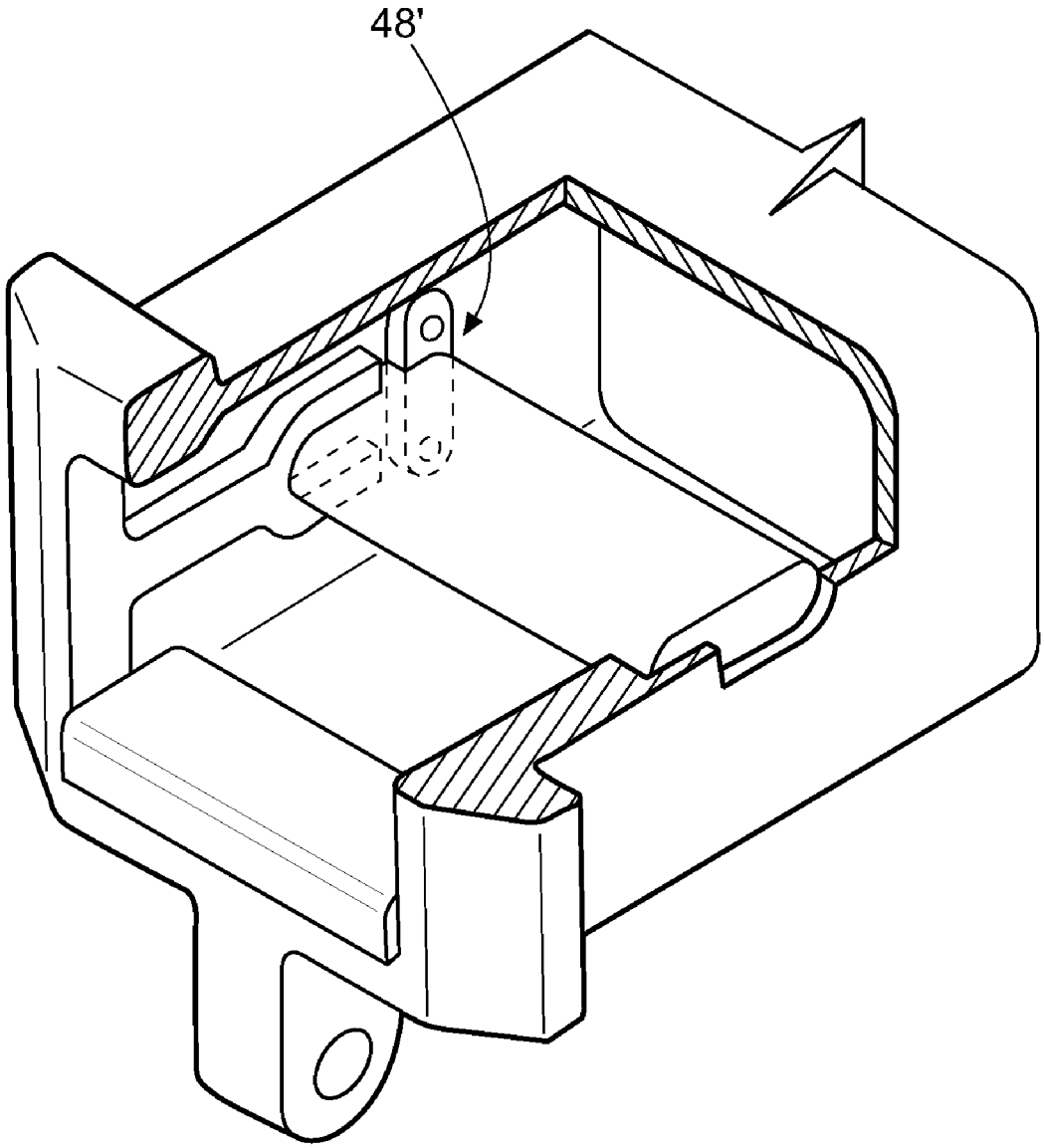
FIG. 5 Prior Art
FIG. 5 is a cutaway view of a yoke, key and key retainer according to another prior art system.

FIG. 5 is a perspective cutaway view of another key retainer system according to the prior art. As with the prior art key retainer shown in dotted lines in FIG. 3, the member 48' contacting the draft key is pivoted into place. Because the key retainer element is located on the inside of the yoke, it cannot be repaired without first disassembling the coupler from the yoke, whereas the key retainer system according to the invention may be repaired from the outside. Likewise, the member 48' can experience lateral load when normal operating loads are applied to the coupler.

The foregoing description of the preferred embodiments is not to be deemed as limiting the claimed invention, which is defined in the appended claims.

The invention claimed is:

1. A key retainer for a railway car coupler key, comprising:

a retainer guide having an open end, a closed end, and two opposed sides extending from the closed end defining a slot;

the retainer guide having two opposed flanges, each of said opposed flanges having a through hole, and said through holes being vertically aligned;

a key stop inserted in the open end of the retainer guide and slidable within the retainer guide to a position abutting the closed end of the retainer guide;

the key stop having a flange having a through hole, said through hole on the key stop being vertically aligned with the through holes on the opposed flanges on the retainer guide when the key stop is abutting the closed end of the retainer guide; and a locking member received in said through holes in the flanges of the retainer guide and key stop to secure the key stop in the retainer guide; wherein, the retainer guide is adapted to be mounted on the outside of a railway car sill having a cutout at one end exposing at least a portion of a key slot on a yoke, so that at least a portion of said retainer guide is aligned with at least a portion of the cutout on the sill, and the locking member does not experience load when a lateral load is applied to the coupler key during normal operation of the railway car.

2. The key retainer according to claim 1, wherein the opposed flanges on the retainer guide extend from the opposed sides of the retainer guide adjacent the closed end of the retainer guide.

3. The key retainer according to claim 1, wherein the cutout on the sill has a closed end, an open end, and sides defining a slot, and wherein opposed sides of the retainer guide are adapted to be aligned with the sides of the cutout, and the closed end of the retainer guide is adapted to be aligned with a closed end of the cutout.

4. The key retainer according to claim 1, wherein substantially an entire facing surface of the key stop abuts a coupler key inserted through key slots on a floating E-type yoke.

5. A key retainer according to claim 1, wherein the retainer guide is welded to the sill.

6. A key retainer according to claim 1, wherein the retainer guide is bolted to the sill.

7. A key retainer according to claim 1, wherein the locking member is a pin having a through hole and further comprising a cotter pin received in a through hole in the pin.

8. A key retainer system according to claim 1, wherein the locking member is a bolt.

9. A key retainer system according to claim 1, wherein the locking member is secured with a threaded connection.

10. A key retainer system for securing a railway car coupler key, comprising:

a sill attached to a lower portion of a railway car, having two opposed lateral sides, having a cutout in one of the lateral sides permitting access to a coupler key, and having an unbroken surface on the lateral side of the sill opposite said cutout;

a yoke adapted to be mounted in the sill, said yoke having a space to receive a cushion unit, a surface for the cushion unit to bear on, and two opposed key slots extending through opposed sidewalls of the yoke;

a coupler key extending completely through the two opposed key slots in the yoke from the cutout in the sill to the unbroken surface on the lateral side of the sill opposite said cutout a key retainer according to claim 1 mounted on the outside of the sill, wherein the locking member received in the through holes of the retainer guide and key stop does not experience load when a lateral load is applied to the coupler key during normal operation of the railway car.

11. The key retainer system according to claim 10, wherein the key slots extending through opposed sidewalls of the yoke are identical.

12. The key retainer system according to claim 10, wherein the coupler key has a length of about 12-¾ inches, and a constant width throughout the length thereof of about 6 inches.

13. The key retainer system according to claim 10, wherein the key retainer is welded to the outside of the sill.

14. The key retainer system according to claim 10, wherein the key retainer is bolted to the outside of the sill.

15. The key retainer system according to claim 10, wherein the cutout on the sill has a closed end, an open end, and sides defining a slot, and wherein opposed sides of the retainer guide are sized to be aligned with the sides of the cutout, and the closed end of the retainer guide is sized to be aligned with a closed end of the cutout, said key retainer system being visible from a lateral side of the railway car.

16. The key retainer system according to claim 10, wherein substantially an entire facing surface of the key retainer abuts a coupler key inserted through key slots on a floating E-type yoke.

17. The key retainer system according to claim 10, wherein the coupler key has rectangular profile viewed from above when the key is inserted in the key slots.

18. The key retainer system according to claim 10, wherein the yoke is free of moving parts on an interior surface thereof.

* * * * *